United States Patent [19]

Lord

[11] Patent Number: 4,627,113

[45] Date of Patent: Dec. 9, 1986

[54] DECORATIVE NECKWEAR

[76] Inventor: Allen Lord, Frenchman's Rd., New Milford, Conn. 06776

[21] Appl. No.: 817,606

[22] Filed: Jan. 10, 1986

[51] Int. Cl.[4] ..... A41D 25/00; A41D 25/02

[52] U.S. Cl. ..... 2/144; 2/150

[58] Field of Search ..... 2/144, 150

[56] References Cited

U.S. PATENT DOCUMENTS

| | | | |
|---|---|---|---|
| 2,642,572 | 6/1953 | Tobias | 2/150 |
| 2,874,386 | 2/1959 | Loomis | 2/150 |
| 3,030,631 | 4/1962 | Tobias | 2/150 |
| 3,829,902 | 8/1974 | Fisher | 2/338 |
| 4,546,494 | 10/1985 | Garber | 2/144 |

*Primary Examiner*—Louis K. Rimrodt

*Attorney, Agent, or Firm*—Mattern, Ware, Stoltz & Fressola

[57] ABSTRACT

A decorative neckwear device incorporates a simulated four-in-hand necktie knot positioned in front of the wearer's neck by an adjustable non-elastic neckband, and supporting a vertically elongated array of a plurality of independent thin flat panels hingingly joined together to form a flexible supple depending panel array. The thin flat panels may be formed of various different colorful decorative materials such as thin sheets of colored glass, plastic, metal or wood veneers, cemented to a supporting fabric strip. Matching pairs of panels bonded to the front and rear faces of the strip form thin sandwich panels, making the panel array attractive when viewed from either front or back.

26 Claims, 5 Drawing Figures

10
11
12
13
14
16
17
18
19
21
22
23
24
26
27
28
29
31
32
33
34
36
37
38
39
40
4

DECORATIVE NECKWEAR

This invention relates to decorative neckwear and particularly to neckwear with flexibly joined, rigid segments, having a unique and highly decorative appearance.

Conventional four-in-hand fabric neckties have been worn by men and, to a lesser extent, by women for many decades. A number of United States patents have shown neckties of various shapes and sizes made of fabric.

U.S. Pat. No. 4,546,494 shows a decorative imitation necktie having two or more rigid panels hingedly joined together. Two embodiments are illustrated in the drawings of this patent, one having two relatively long wood panels joined by brass hinges, and another with heavy rounded bars adhered to a backing strip of canvas or resilient, synthetic plastic material to produce a tambour construction, the wooden blocks being described as a plurality of segments of generally semi-circular cross-section. Thus both of these prior art proposals involve relatively heavy, bulky and inflexible articles of wearing apparel. It has now been discovered that far more comfortable, attractive, safe and decorative articles of neckwear may be provided in accordance with the principles of the present invention.

This invention is characterized by a plurality of flexibly joined extremely thin rigid panels, which may be inlaid in contrasting colors or may alternate different colors to produce contrasting stripes or patterns. Thin panels of sheet metal, sheet plastic, wood or glass in attractive colors may be employed. The flexible connections between these extremely thin, rigid panels preferably take the form of a sheet of thin synthetic fabric which may be woven or non-woven nylon, rayon or dacron, or similar fabric. A single thin sheet layer of separate panels of rigid decorative material is cemented on each face of the fabric to form thin "sandwich" panels, all flexibly joined to similar adjacent sandwich panel of the same or contrasting sheet material. These flexibly joined arrays of extremely thin rigid panels are preferably formed in the shape of a depending four-in-hand necktie whose upper end terminates in a replica of a four-in-hand knot, secured around the wearer's neck under the collar by a pair of non-elastic ribbons, which may be detachably joined together by hook and loop area or "Velcro" fasteners secured to their respective overlapping ends.

Accordingly, a principal object of the present invention is to provide an extremely lightweight and highly decorative article of neckwear Another object of the invention is to provide such decorative neckwear with contrasting colors of rigid sheet material forming individual flat panels, flexibly joined together.

A further object of the invention is to provide such decorative articles of neckwear incorporating safe and effective non-elastic adjustable supporting neckband ribbons having their ends adapted for adjustable engagement to secure the device in position under the wearer's collar.

A still further object of the invention is to provide such decorative neckwear articles closely resembling in appearanc the supple lightweight impression created by fabric neckties while also providing the much admired warmth and beauty of natural wood grain, or the striking color effects achieved by colorfully anodized aluminum, colored glass or brightly colored plastic, or if desired the many choices of ribbed, striated, glazed or mottled surfaces available with such materials.

Still another object of the invention is to provide such decorative neckwear articles having a successive array of transverse hinge lines, each capable of limited hinging movement both forward and backward, to provide the capability for supple undulatory movement resembling natural fabric neckties.

A further object of the invention is to provide such decorative neckwear articles incorporating a plurality of thin flat rigid neckband panels hingedly joined together extending laterally from the upper end of the article to form the proximal portion of each half of the neckband and positioned to extend under the wearer's collar.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

THE DRAWINGS

For a fuller understanding of the nature and objects of the invention, reference should be had to the following detailed description taken in connection with the accompanying drawings, in which.

BEST MODE FOR CARRYING OUT THE INVENTION

Figures 1, 2, 3, 4, 5:
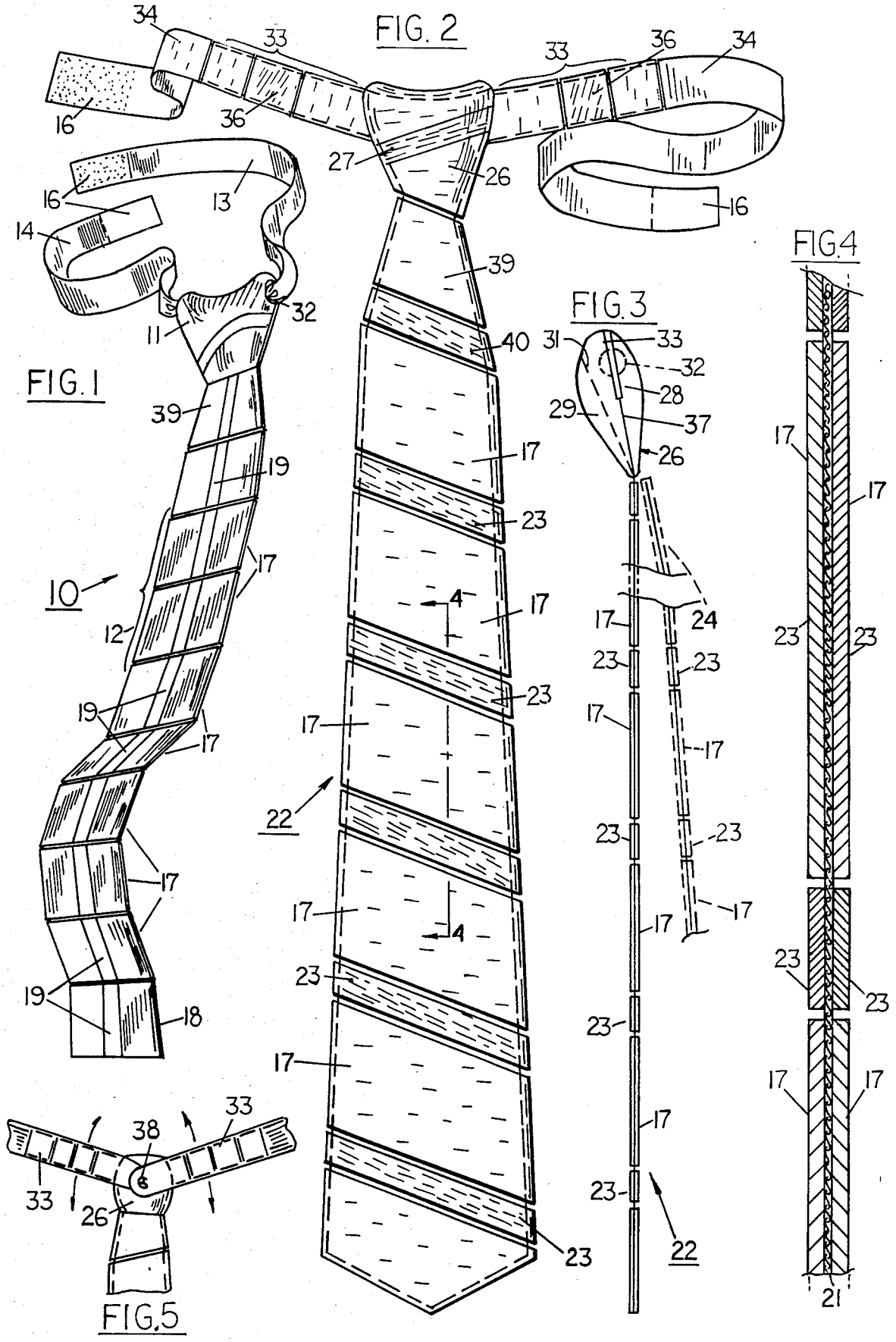
FIG. 1 is a perspective view of one embodiment of the invention having a series of generally rectangular panels flexibly joined together in a vertical array topped by a trapezoidal panel joined to a thicker shaped block simulating a four-in-hand knot, having neckband ribbons secured thereto.
FIG. 2 is a front elevation view of a different embodiment of the invention incorporating a series of generally parallelogram shaped panels flexibly joined together in a vertical array of diminishing width with comparable narrower, smaller panels forming the central portions of the neckband and flanking the four-in-hand knot at the top of the device.
FIG. 3 is a side elevation view partially broken away of the embodiment of FIG. 2.
FIG. 4 is a greatly enlarged fragmentary side elevation view of the embodiment in FIG. 2, taken along the line 4–14 in FIG. 2, showing the preferred construction of this embodiment.
FIG. 5 is a fragmentary rear elevation view of an alternative self-adjusting neckband attachment to the rear face of the simulated four-in-hand knot component of the device.

In the embodiment of the invention shown in FIG. 1, the neckwear device 10 is shown to comprise a simulated knot 11 to be worn under the wearer's chin, a flexible depending panel array 12 comprising a plurality of extremely thin, flat panels hingingly joined together in a vertical array extending downward from knot 11, and a two-part neckband 13-14. The neckband 13 extends laterally in one direction from the upper side portion of knot 11, while the neckband portion 14 extends laterally in the other direction, ribbon fashion, from the opposite side of knot 11. As indicated in FIG. 1, the neckband ribbon portions 13 and 14 may be opposite ends of a single piece of ribbon threaded through a laterally extending bore 32 passing through the entire upper portion of knot 11 from side to side. The distal ends of neckband ribbon portions 13 and 14 are each provided with easily adjustable securing devices, preferably formed as hook and loop area or "Velcro" fasteners 16 respectively stitched to the ends of the opposite neckband ribbon portions 13 and 14 as indicated in FIG. 1.

It will be noted that the neckwear device 10 shown in FIG. 1 is formed of nine, ten or more panels 17 which are substantially rectangular in shape. The lowermost of these, panel 18, is also rectangular, providing a straight horizontal transverse lower end of panel array 12.

Rectangular panels 17 may be uniform in color if made of a single wood veneer, for example, or may present the appearance of two or more colors if one or more central stripes 19 of contrasting colored wood veneer are laminated or inlaid in the face of each panel 17, is illustrated in FIG. 1. For example, one or more strips 19 of birch or maple veneer may be positioned between adjacent strips of rosewood, walnut or mahogany veneer, producing contrasting shades of attractively grained wood panels which may be extremely thin.

These veneer panels are preferably cemented by synthetic polymer adhesives to a thin flexible strip of synthetic fabric such as nylon, rayon or dacron ribbon. This fabric strip 21 may been seen, sandwiched between thin wood veneer panels 17 and 23 in the greatly enlarged cross-sectional side elevation view of FIG. 4, where strip 21 is illustrated as a strip of woven fabric. Nonwoven or "felted" synthetic fiber fabric may also be used if desired, provided the felted fibers are long enough to bridge the narrow gaps between adjacent flat panels and afford substantial resistance to tearing if a twisting force is imparted to two adjacent panels 17, which might otherwise tear the hinge line between the two panels.

In the embodiment of the invention shown in FIG. 2, the thin flat panels 17 are shown in the front elevation view of FIG. 2 and in the side elevation view of FIG. 3 where their extreme thinness is clearly shown as compared with their width in FIG. 2. A narrow panel 23 of a contrasting color wood is shown interposed between each panel 17 in FIG. 2. If panels 17 are formed of maple veneer, for example, darker panels 23 may be formed of walnut veneer. In this embodiment these panels 17 and 23 are substantially parallelogram shaped, with each darker panel 23 forming a diagonal band across the panel array, so that the flexible array resembles a regimental striped four-in-hand necktie.

The overall panel array 22 is shown hanging flat in FIGS. 2 and 3, but it will be understood that its supple flexibility permits it to flex and undulate in both directions, in the manner illustrated in FIG. 1, making its appearance similar to that of a fabric four-in-hand tie.

Panel array 22 is so extremely thin, as shown in FIG. 3, that a second narrower panel array may be mounted behind it to replicate the narrow end of a standard fabric four-in-hand necktie. This second panel array is shown in dash lines identified by the reference character 24 in FIG. 3, and both panel arrays 23 and 24 are so light in weight that the neckwear device closely matches in size, shape and weight the characteristics of a fabric necktie.

The upper end of panel arrays 22 and 24 is a simulated knot 26 shown at the upper ends of FIGS. 2 and 3 and preferably formed of the same material as the panels 17. A contrasting inlaid stripe 27 may be added to simulated knot 26, as shown in FIG. 2. Each of the simulated knots 11 and 26 is shaped to resemble a fabric four-in-hand necktie knot with substantial thickness in its midsection softly rounded around its upper inside edges and tapered toward a flat thin lower edge where it is flexibly joined to the depending panel array. When wood veneers are employed to produce the thin panel arrays, similar woods are used in the fabrication of the simulated knots 11 or 26 as indicated in the FIGURES.

As shown in the side elevation view of FIG. 3, simulated knot 26 is formed of two parts—a rear portion 28 and a front portion 29. The rear face of front portion 29 and the front face of rear portion 28 are formed as mating facing surfaces preferably flat between which the upper end of the fabric strip 21 extends. The two knot portions 28 and 29 are cemented together sandwiching strip 21 between their mating facing surfaces, for example, along the plane 37 shown in FIG. 3.

Several alternative forms of neckband for the devices of this invention are illustrated in the drawings. FIG. 1 shows the simple, single ribbon neckband threaded through a transverse hole 32 extending from side to side through the upper portion of simulated knot 11 and the two ends 13 and 14 of the ribbon are shown extending laterally from each side of the knot 11 with their "Velcro" strips facing each other for overlapping securement behind the wearer's neck under the collar.

Since collars are often worn open and widespread collars often show more of the narrow portion of conventional neckties extending around the neck, the embodiment in FIG. 2 shows a different neckband construction employing thin flexibly hinged panel arrays 33 extending laterally at upwardly inclined angles from the upper side portions of simulated knot 26. These panel arrays 33 are preferably formed as narrower versions of the panel array 22 forming the depending decorative portion of the device and they are thus formed of similar thin wood veneer layers cemented to the faces of a narrow synthetic fabric ribbon 34. At least the one or two panels of arrays 33 adjacent to simulated knot 26 may incorporate laminated segments of contrasting colors in corresponding striped configurations, or contrasting color panels similar to panels 23 may be interposed, such as the panels 36 shown in FIG. 2. The overlapping ends of neckband ribbons 34 are preferably provided with "Velcro" fasteners 16, similar to the neckband of FIG. 1.

When the narrow panel arrays 33 are employed as the portions of neckband ribbons adjacent to the simulated knot 26, as shown in FIG. 2, the ribbon 34 may be cemented between the front and rear portions of knot 26 in the same manner that fabric strip 21 is cemented. For this purpose, the mating facing surfaces of the two portions of knot 26 are positioned along a plane 37 subdividing knot 26 at its widest portions, as indicated in FIG. 3. A plane 31, closer to the either the front or the rear face of knot 26, may be used with the neckband of FIG. 1, and positioned to avoid intersecting a transverse hole 32, both as shown in dash lines in FIG. 3.

An alternative construction joining narrow neckband panel arrays 33 to the rear face of simulated knot 26 is shown in FIG. 5 wher the two proximal ends of the neckband segments 34 terminating in panel arrays 33 are overlapped and provided with aligned apertures permitting a pivot grommet or screw 38 to join the overlapped arrays 33 to simulated knot 26 for angular pivotal adjustment, thus readily fitting the collar style and neck size of different wearers.

In each of the embodiments shown in the Figures, the uppermost one or two panels of the panel arrays 12 or 22 are preferably formed as trapezoids with upwardly converging side edges, serving to connect the vertical panel array with the simulated knot 11 or 26. Thus the trapezoidal panels 39 and 40 closely match the individual panels 17 except for their converging side edges.

The thin flat panels of these neckwear devices may be formed of thin sheets of colorful plastic, glass or metal, with smooth or textured surfaces, or of thin wood veneers as described above, producing unique and striking visual effects.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense It is also to be understood that the following claims are intended to cover all of the generic and specific features of the invention herein described, and all statements of the scope of the invention which, as a matter of language, might be said to fall therebetween.

What is claimed is:

1. A decorative neckwear device incorporating

A. a pillow-shaped simulated knot having a generally trapezoidal edge outline shape with a convex front face and a rear face converging downwardly toward each other from an upper central region of substantial thickness, with both faces terminating in a thin lower edge, B. a vertically elongated fabric strip having an upper end secured to the lower edge of the simulated knot, a front face, a rear face, and a depending lower end, C. a first plurality of substantially rigid thin flat panels of sheet material, each being less than one-tenth the thickness of the central region of the simulated knot and having upper and lower parallel edges, all said thin flat panels being successively adhesively bonded to the front face of the fabric strip , with the lower edge of each panel positioned parallel to and closely adjacent to the upper edge of the next lower panel, D. a corresponding second plurality of substantially rigid thin flat panels of sheet material, each substantially corresponding in shape and thickness to a juxtaposed one of said first plurality of panels, and each successively adhesively bonded to the rear face of the fabric strip with its upper and lower edges substantially juxtaposed to corresponding respective upper and lower edges of said juxtaposed one of said first plurality of panels, forming a suple and resiliently flexibly hinged panel array of successive thin, flat sandwich panels connected for free undulatory flexing movement with both positive and negative curvature in adjacent regions of the array, and E. non-elastic neckband means connected to the simulated knot and protruding laterally therefrom to encircle the wearer's neck, having a first end and a second end adjustably and releasably securable to the first end, whereby the simulated knot is positioned in front of the wearer's neck, displaying the flexibly arrayed plurality of flat panels vertically depending therefrom.

2. The neckwear device defined in claim 1 wherein the fabric strip is formed of woven synthetic fibers.

3. The neckwear device defined in claim 2 wherein the uppermost panel of the panel array is substantially trapezoidal, with its upper edge and the thin lower edge of the simulated knot having substantially the same transverse width.

4. The neckwear device defined in claim 1 wherein the fabric strip is formed of non-woven synthetic fiber material.

5. The neckwear device defined in claim 1 wherein alternate panels of the panel array are formed of sheet materials exhibiting contrasting colors.

6. The neckwear device defined in claim 1 wherein alternate panels of the panel array are formed of sheet material segments of contrasting vertical widths.

7. The neckwear device defined in claim 1 wherein successive panels of the panel array are provided with upwardly converging side edges.

8. The neckwear device defined in claim 1 wherein the panels of the panel array are substantially rectangular, with horizontal upper edges and lower edges.

9. The neckwear device defined in claim 1 wherein the majority of panels of the panel array are substantially shaped as parallelograms, with diagonal parallel upper edges and lower edges.

10. The neckwear device defined in claim 9, wherein the diagonal parallel edges are slanted at an angle between about 60 degrees and about 80 degrees from the longitudinally elongated side edges of the panel array.

11. The neckwear device defined in claim 1 wherein the flat panels of sheet material are metal.

12. The neckwear device defined in claim 1 wherein the flat panels of sheet material are glass.

13. The neckwear device defined in claim 1 wherein the flat panels of sheet material are plastic.

14. The neckwear device defined in claim 1 wherein the flat panels of sheet material are wood veneer.

15. The neckwear device defined in claim 14 wherein the flat panels of wood veneer include at least two contrasting colors of wood.

16. The neckwear device defined in claim 15 wherein the simulated knot incorporates at least one contrasting color wood inlay.

17. The neckwear device defined in claim 15 wherein the flat panels of wood veneer incorporate at least one contrasting color wood inlay.

18. The neckwear device defined in claim 1, wherein both ends of the neckband means are formed as ribbons protruding laterally from opposite upper corners of the simulated knot.

19. The neckwear device defined in claim 18 wherein the neckband means is formed as a single ribbon extending through a transverse bore passing laterally through the upper portion of the simulated knot.

20. The neckwear device defined in claim 18 wherein the neckband ribbon ends are formed as ends of a single ribbon, and wherein the simulated knot is divided into a front knot portion and a rear knot portion provided with facing surfaces flanking and adhesively bonded to the respective faces of the single ribbon.

21. The neckwear device defined in claim 18, wherein each of said upper corners of the simulated knot is provided with an outward facing slot, and each neckband ribbon is provided with a proximal end embraced and secured within one said upper corner slot.

22. The neckwear device defined in claim 21, wherein at least a three-inch length of each neckband ribbon closest to the simulated knot is formed as a neckband panel array of thin flat sandwich panels narrower than and corresponding in appearance to those sandwiching the vertically elongated fabric strip.

23. The neckwear device defined in claim 1 wherein both ends of the neckband means are distal ends, dimensioned to overlap behind the wearer's neck, and are provided with respective cooperating hook and loop area fasteners detachably and adjustably securable together.

24. The neckwear device defined in claim 23 wherein the neckband means is formed of fabric ribbon of which the portions closest to the simulated knot are formed as neckband panel arrays of successive thin flat sandwich panels narrower than and corresponding in appearance to those sandwiching the vertically elongated fabric strip.

25. The neckwear device defined in claim 24 wherein the proximal panel of each neckband panel array is provided with a pivot aperture therethrough, and further including neckband pivot means pivotally anchoring each neckband panel array through its pivot aperture to the rear face of the simulated knot, providing angular pivoting self-adjustment accommodating the neckband to the wearer's neck.

26. The neckwear device defined in claim 1 wherein the thin lower edge of the simulated knot is provided with a transverse slot, and the upper end of the elongated fabric strip is embraced and secured within said slot.

* * * * *